US012644338B2

(12) United States Patent
Blundell

(10) Patent No.: US 12,644,338 B2
(45) Date of Patent: Jun. 2, 2026

(54) DRILL BIT ASSEMBLY FOR REVERSE CIRCULATION HAMMER

(71) Applicant: MINCON INTERNATIONAL LIMITED, Shannon (IE)

(72) Inventor: Carl Blundell, Byford (AU)

(73) Assignee: MINCON INTERNATIONAL LIMITED, Shannon (IE)

( * ) Notice: Subject to any disclaimer, the term of this patent is extended or adjusted under 35 U.S.C. 154(b) by 0 days.

(21) Appl. No.: 18/856,086

(22) PCT Filed: Apr. 6, 2023

(86) PCT No.: PCT/EP2023/059190
§ 371 (c)(1),
(2) Date: Oct. 11, 2024

(87) PCT Pub. No.: WO2023/198609
PCT Pub. Date: Oct. 19, 2023

(65) Prior Publication Data

US 2025/0250862 A1 Aug. 7, 2025

(30) Foreign Application Priority Data

Apr. 14, 2022 (IE) ..... 2022/0068

(51) Int. Cl.
*E21B 1/38* (2006.01)
*E21B 10/38* (2006.01)
(Continued)

(52) U.S. Cl.
CPC ..... *E21B 1/38* (2020.05); *E21B 10/38* (2013.01); *E21B 10/61* (2013.01); *E21B 49/08* (2013.01)

(58) Field of Classification Search
CPC . E21B 1/38; E21B 10/38; E21B 10/61; E21B 49/08
See application file for complete search history.

(56) References Cited

U.S. PATENT DOCUMENTS 4,819,746 A 4/1989 Brown et al.
11,933,143 B1 * 3/2024 Aros ..... E21B 10/38
2020/0370373 A1 * 11/2020 Aros ..... E21B 10/38

FOREIGN PATENT DOCUMENTS

AU 2004259781 B2 8/2010
EP 0692062 A1 1/1996
(Continued)

OTHER PUBLICATIONS

International Search Report from corresponding International Patent Application No. PCT/EP2023/059190, dated Jun. 28, 2023.
(Continued)

*Primary Examiner* — Michelle Lopez
(74) *Attorney, Agent, or Firm* — RENNER, OTTO, BOISSELLE & SKLAR, LLP

(57) ABSTRACT

A drill bit assembly for a reverse circulation down-the-hole hammer includes a percussion bit having a head portion with a cutting face at a forward end thereof with engagement means on the head portion for engagement with complementary engagement means on a drive chuck whereby rotational drive from the drive chuck may be transmitted to the percussion bit. Connection means are provided on the drive chuck adapted for connecting the drive chuck to a drive means of the down-the-hole hammer. The percussion bit includes a central bore in fluid communication with the cutting face of the bit for returning a sample of drilled cuttings to the surface, a first plurality of flushing grooves in an outer surface of the head portion, and a second plurality of flushing grooves in an outer surface of the head portion.

15 Claims, 5 Drawing Sheets

(51) Int. Cl.
*E21B 10/61* (2006.01)
*E21B 49/08* (2006.01)

(56) References Cited

FOREIGN PATENT DOCUMENTS

| | | | |
|---|---|---|---|
| EP | 0692062 | B1 | 6/1999 |
| WO | WO-94/24405 | A1 | 10/1994 |
| WO | WO-2005/010317 | A1 | 2/2005 |
| WO | WO-2007/010513 | A1 | 1/2007 |

OTHER PUBLICATIONS

Written Opinion from the International Searching Authority issued in International Patent Application No. PCT/EP2023/059190 dated Jun. 28, 2023.
Written Opinion from the International Preliminary Examining Authority issued in International Patent Application No. PCT/EP2023/059190 dated Mar. 21, 2024.
International Preliminary Report on Patentability from the International Preliminary Examining Authority issued in International Patent Application No. PCT/EP2023/059190 dated Jul. 3, 2024.

* cited by examiner

DRILL BIT ASSEMBLY FOR REVERSE CIRCULATION HAMMER

FIELD OF THE INVENTION

The present invention relates to reverse circulation drilling and, in particular, to improvements in sample collection during reverse circulation drilling.

BACKGROUND TO THE INVENTION

Conventional down-the-hole hammers and fluid-operated percussion drill tools typically include an external cylinder or outer wear sleeve, within which is mounted an inner cylinder which in turn engages with a backhead assembly. A sliding reciprocating piston co-operates with the inner cylinder and backhead assembly, so that when pressure fluid is supplied through the backhead assembly, the piston acts with a percussive effect on a drill bit retained within a drive chuck on the outer wear sleeve. The drill bit is typically formed with an axially extending shank. Axially extending splines on the shank are slideably engageable with complementary splines formed internally on the drive chuck to transmit rotational drive from the drive chuck to the bit shank. Bit retaining means, such as a bit retaining ring, engages with a shoulder at an upper end of the bit shank to retain the bit in the drill bit assembly. Pressurised air, known as flushing air, is used to flush cuttings out of the hole while the hammer operates. The flushing air may travel along the splines, with grooves provided in the outer surface of the bit head to direct the air from the splines to the cutting face of the bit.

In standard down-the-hole hammers, the flushing air, along with the drilled cuttings, is flushed out of the ground through an annulus between the hammer and the drilled hole. Reverse circulation drilling is a method of drilling in which the flushing air, along with the drilled cuttings, travels through flushing channels in the bit and into a central bore of the hammer, called a sample tube bore. This allows a steady flow of cuttings to be returned to the surface for collection and analysis. This is most commonly used in exploration drilling, in order to determine optimal drilling locations. Samples collected can provide information regarding the location, depth, quantity and type of mineral or ore in an area.

A disadvantage associated with existing reverse circulation arrangements is that a low percentage of the drilled cuttings may be recovered via the sample tube.

SUMMARY OF THE INVENTION

According to an aspect of the invention, there is provided a drill bit assembly for a reverse circulation down-the-hole hammer, comprising:

- a percussion bit having a head portion with a cutting face at a forward end thereof;
- engagement means on the head portion for engagement with complementary engagement means on a drive chuck whereby rotational drive from the drive chuck may be transmitted to the percussion bit; and
- connection means on the drive chuck adapted for connecting the drive chuck to a drive means of the down-the-hole hammer;
- wherein the percussion bit includes:
  - a central bore in fluid communication with the cutting face of the bit for returning a sample of drilled cuttings to the surface,

- a first plurality of flushing grooves in an outer surface of the head portion, configured to deliver a supply of flushing medium, such as air, to the cutting face of the bit; and
  - a second plurality of flushing grooves in an outer surface of the head portion, configured to deliver a supply of flushing medium to the central bore.

An advantage of this arrangement is that, by providing a portion of the flushing medium directly to the central bore of the bit via the second plurality of flushing grooves, a suction effect is created which increases the percentage of the sample of the drilled cuttings that is returned to the surface. Another advantage of this arrangement is that, by reducing the proportion of flushing medium that is delivered to the bit face, the amount of flushing medium that leaks around the outside of the hammer is also reduced, thereby increasing upstream flow rate in the central bore of the bit.

The percussion bit may include a bit retaining portion, and the drill bit assembly may further include bit retaining means adapted for engagement with the bit retaining portion of the percussion bit to retain the percussion bit in the drill bit assembly. The bit retaining portion of the percussion bit may include a retaining shoulder. The retaining shoulder may be provided at a rear end of the bit. The bit retaining means may include a bit retaining ring disposed rearwardly of the drive chuck, for example, between an aligner and the drive chuck, and arranged to engage the bit retaining portion of the percussion bit to retain the bit in the bit assembly.

At least one inlet may be provided in the cutting face of the bit, in fluid communication with the central bore. At least one, and preferably a plurality of flushing channels may extend between the cutting face and the central bore of the percussion bit for returning a sample of drilled cuttings to the surface. For example, two flushing channels may extend between the cutting face of the bit and a forward end of the central bore. This allows flushing medium that is supplied to the cutting face of the bit via the first plurality of flushing grooves to carry drilled cuttings through the flushing channels and into the central bore of the bit for return to the surface.

The head portion of the percussion bit may be formed with an axially extending shank and the engagement means may include a plurality of axially extending splines on the shank slideably engageable with a plurality of complementary splines formed internally of the drive chuck whereby rotational drive from the chuck may be transmitted to the shank.

In other embodiments, the engagement means may include an octagonal or hexagonal shank on the percussion bit and the complementary engagement means may include a correspondingly formed chuck. For example, the shank may be hexagonal in cross-section and the chuck may be formed with a double-hexagonal internal profile, such that the shank is engageable with one of the hexagonal profiles of the chuck, allowing flushing medium to pass through channels formed between the shank and the second hexagonal profile. A similar arrangement is also possible for other profiles, such as octagonal profiles.

Each of the first plurality of flushing grooves may extend from the engagement means, such as the splined portion of the bit, to the cutting face of the bit to provide a fluid path for the flushing medium to the cutting face of the bit.

Each of the second plurality of flushing grooves may be in fluid communication with a corresponding bore feed channel, each bore feed channel extending through the bit from an outer surface of the bit head to the central bore to provide a fluid path for the flushing medium to the central bore of the bit. Thus, a portion of the flushing medium may be provided directly to the central bore of the bit via the second plurality of flushing grooves and the corresponding bore feed channels. The bore feed channels may also be referred to as Venturi channels or restriction channels, as a Venturi effect may be experienced by flushing medium passing therethrough. An advantage of this arrangement is that the velocity of the flushing medium in a rearward or upward direction is increased, thereby increasing the percentage of the sample of the drilled cuttings that is returned to the surface via the central bore of the bit.

Each bore feed channel may extend between the outer surface of the bit head and the central bore in a rearward direction. Each bore feed channel may extend between the outer surface of the bit head and the central bore at an acute angle to a longitudinal axis of the percussion bit. By arranging the bore feed channels in this way, the flushing medium supplied to the central bore is directed rearwardly of the hammer, thereby increasing the suction effect which in turn increases the percentage of drilled cuttings returned to the surface.

Each of the bore feed channels may be substantially smaller in diameter than the flushing channels. For example, the bore feed channels may be five to 10 times smaller in diameter than the flushing channels. Each bore feed channel may have a constant diameter along its length. In one embodiment, the bore feed channels may be about seven times smaller in diameter than the flushing channels. The bore feed channels may also be substantially smaller in diameter than the central bore and/or the flushing grooves. This relatively small diameter ensures that stresses in the bit are kept low, despite the introduction of additional holes in the same portion of the bit as the flushing channels.

Preferably, a forward end of each of the second plurality of flushing grooves is sealed to prevent flushing medium from flowing to the cutting face of the bit. This allows all (or almost all) of the flushing medium supplied to the second plurality of flushing grooves to flow into the central bore of the bit, via the bore feed channels. This may be achieved by way of an annular component, such as a chuck sleeve or an extended portion at the forward end of the chuck. The annular component may include a chuck sleeve arranged to extend around the bit head forwardly of the drive chuck. An inner diameter of the component, such as the chuck sleeve or extended chuck portion, may correspond to an outer diameter of the bit head portion, that is, an inner surface of the annular component may provide a close sliding fit with an outer surface of the bit head portion. A forward end of each of the second plurality of flushing grooves may be sealed by the annular component, such that the flushing medium is directed into the corresponding bore feed channel. Each of the first plurality of flushing grooves may extend from the engagement means, such as the splined portion of the bit, to the cutting face of the bit between the outer surface of the bit head and an inner surface of the chuck sleeve to provide a fluid path for the flushing medium to the cutting face of the bit.

In an embodiment, approximately 25% of the flushing medium supplied to the hammer may be provided directly to the central bore of the bit. For example, the first plurality of flushing grooves may include three times as many flushing grooves as the second plurality of flushing grooves.

DETAILED DESCRIPTION OF THE DRAWINGS

Figure 1:
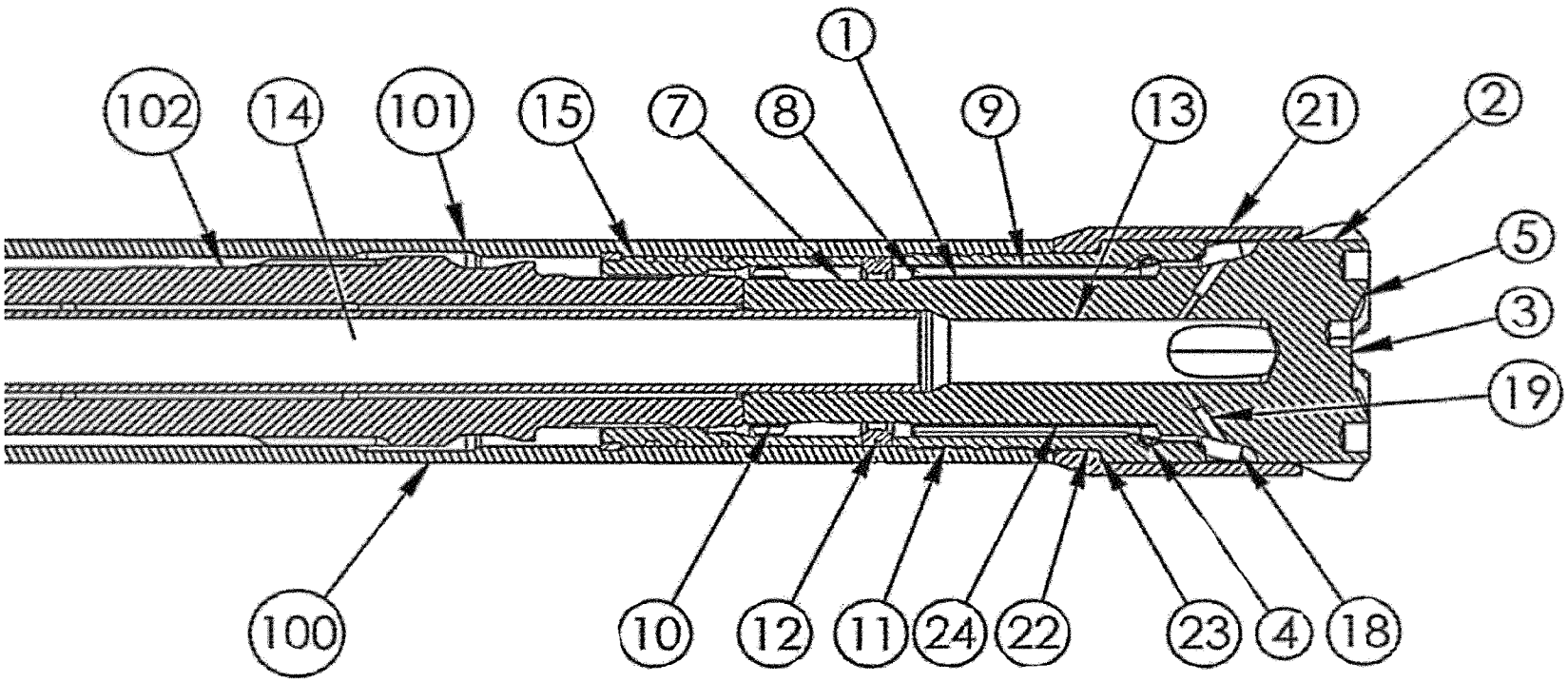
FIG. 1 is a cross-sectional view of a portion of a reverse circulation down-the-hole hammer comprising a drill bit assembly according to the present invention.

Referring to FIG. 1 of the drawings, there is illustrated a forward portion of a reverse circulation hammer 100 which includes a drill bit assembly 1 according to the present invention. The hammer 100 includes an external cylindrical outer wear sleeve 101. The drill bit assembly includes a percussion bit 2 located at the forward end of the wear sleeve. A sliding piston 102 is mounted for reciprocating movement within the outer wear sleeve to strike the percussion bit.

The bit 2 includes a head portion 3 with a cutting face 5 at a forward end thereof, a bit retaining shoulder 10 at a rear end thereof and an axially extending shank 7 therebetween. The shank is formed with a plurality of axially extending splines 8. The drill bit assembly further includes a drive chuck 4, provided with screw-threaded connection means 11 for connecting the drive chuck to the rotating outer wear sleeve. A plurality of complementary splines 9 are formed internally of the drive chuck and are slidably engageable with the splines on the bit shank, whereby rotational drive from the chuck may be transmitted to the shank. In an alternate embodiment, the shank is hexagonal (or octagonal) in cross-section and the chuck is formed with a double-hexagonal (or double-octogonal) internal profile, such that the shank is engageable with one of the hexagonal (or octagonal) profiles of the chuck.

A bit retaining ring 12 is arranged to engage with the bit retaining shoulder 10 on the percussion bit to retain the bit in the assembly. The bit retaining ring is disposed between an aligner 15 and the drive chuck.

Figure 2:
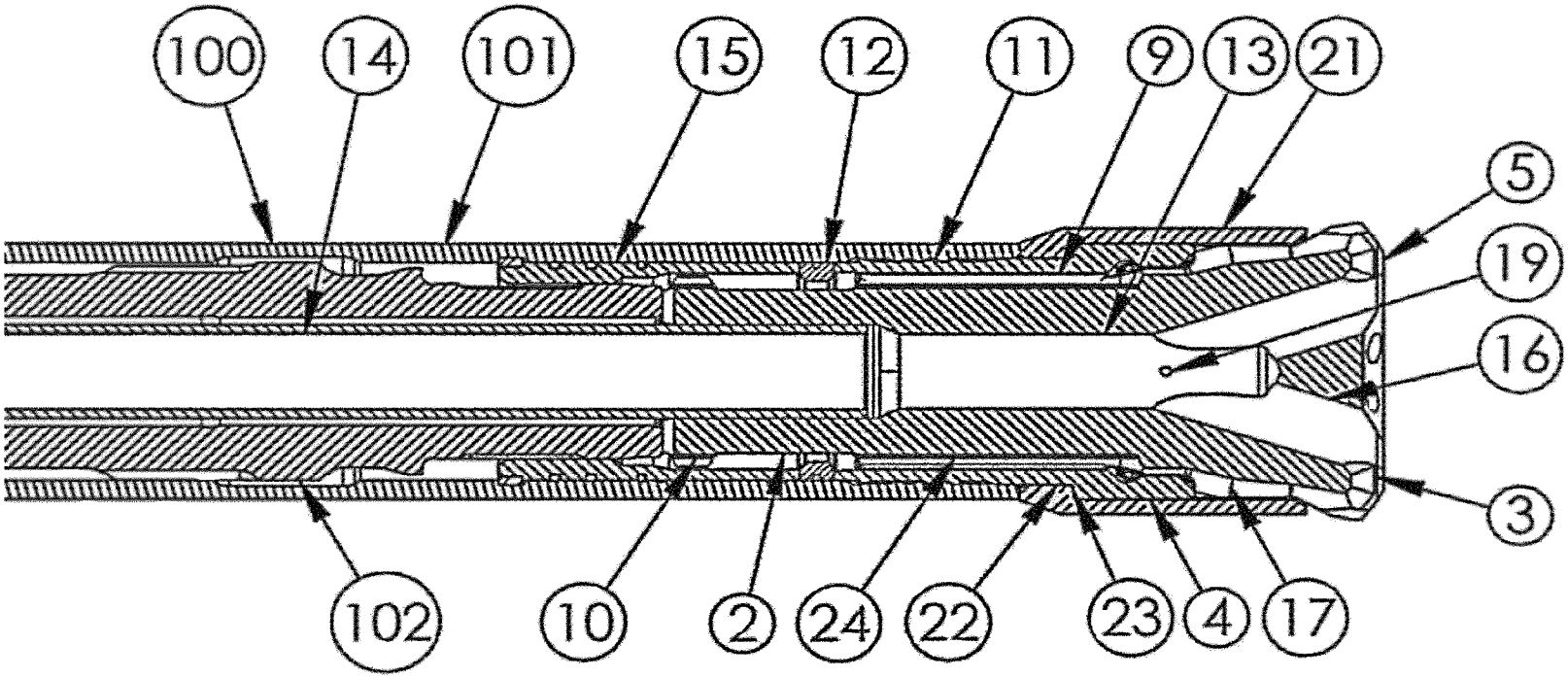
FIG. 2 is another cross-sectional view of a portion of the reverse circulation hammer of FIG. 1, rotated relative to the view shown in FIG. 1.
Figure 3:
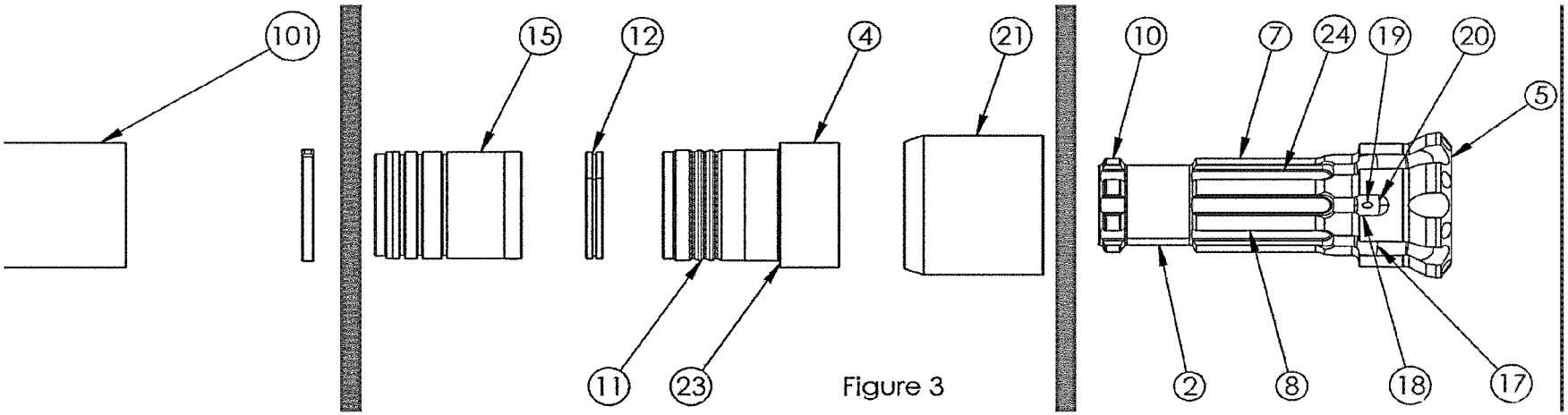
FIG. 3 is an exploded view of elements of the reverse circulation hammer of FIG. 1.
Figure 4:
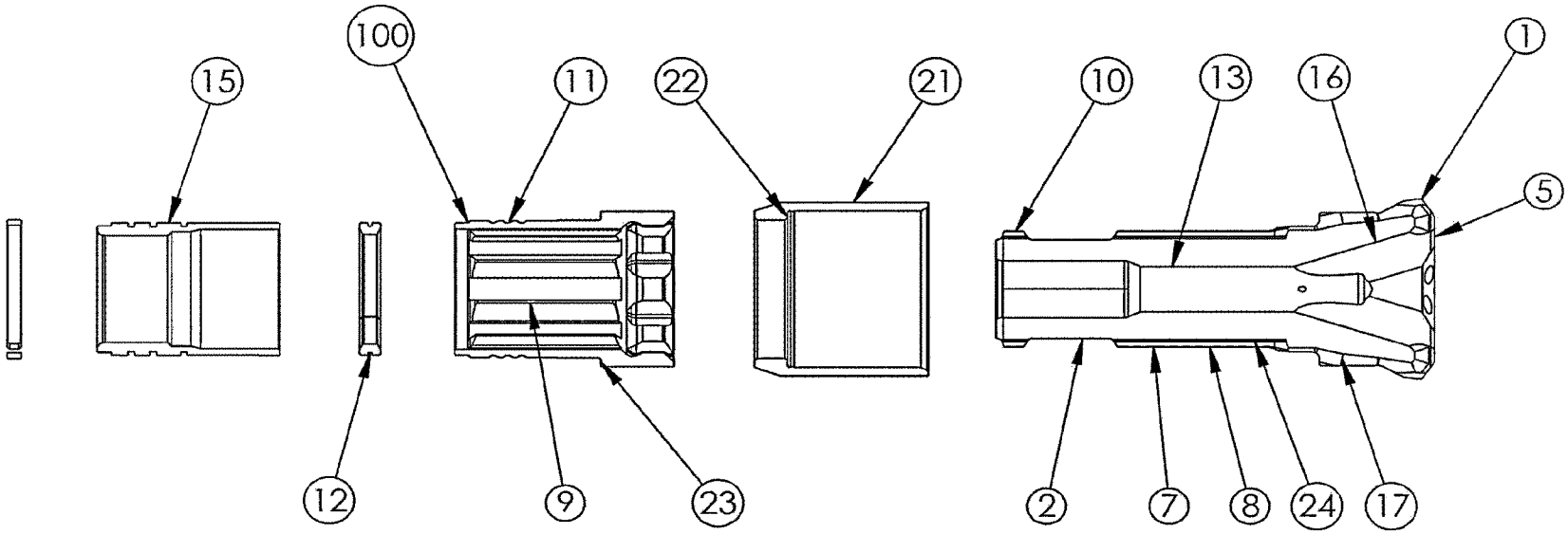
FIG. 4 is a cross-sectional exploded view of the elements of the reverse circulation hammer shown in FIG. 3.
Figure 5:
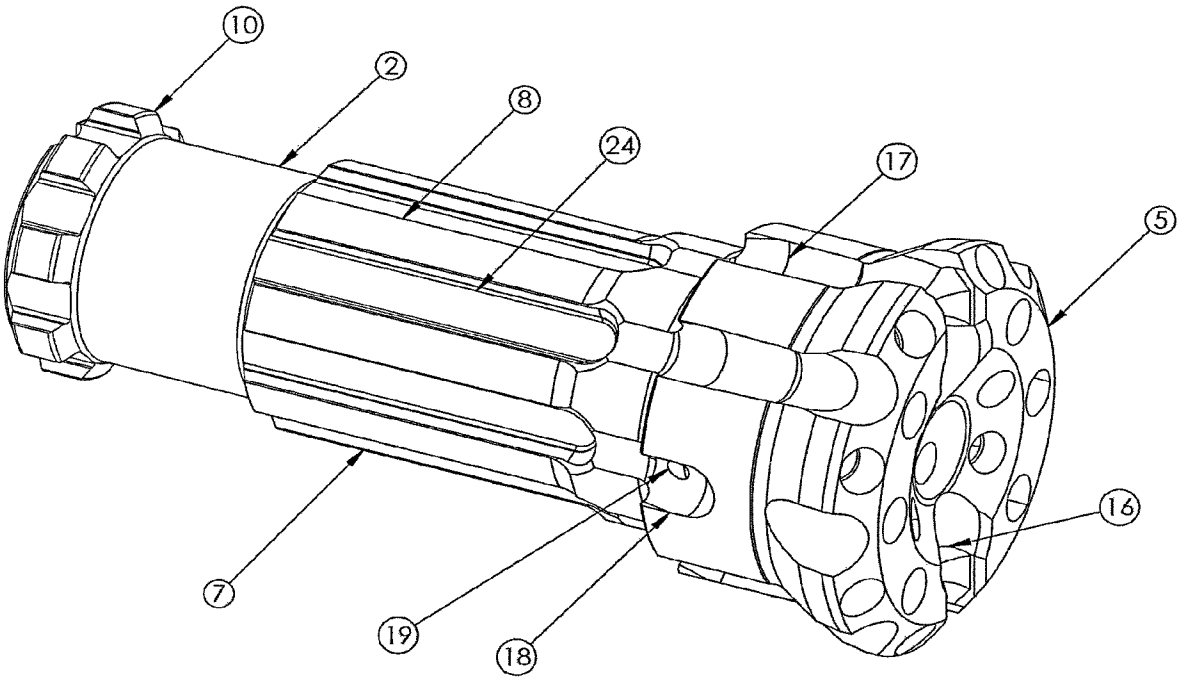
FIG. 5 is an isometric view of the percussion drill bit of the drill bit assembly shown in FIG. 1.

The percussion bit 2 includes a central bore 13 in fluid communication, via two flushing channels 16, with the cutting face 5 of the bit for returning a sample of drilled cuttings to the surface via a sample tube bore 14 in the hammer. In the embodiment shown, the central bore may be approximately 35 mm in diameter and each of the flushing channels may be approximately 28 mm in diameter. As shown in FIGS. 2, 4 and 5, the flushing channels 16 extend between the cutting face and the central bore of the percussion bit. As shown in FIGS. 2, 3 and 5, the percussion bit also includes a first plurality 17 of flushing grooves in an outer surface of the head portion 3, configured to deliver a supply of flushing medium to the cutting face of the bit. Each of the first plurality 17 of flushing grooves extends from the splined portion 8 of the bit to the cutting face 5 of the bit to provide a fluid path for the flushing medium to the cutting face of the bit.

The percussion bit 2 further includes a second plurality 18 of flushing grooves in an outer surface of the head portion, configured to deliver a supply of flushing medium to the central bore. Each of the second plurality 18 of flushing grooves extends from the splined portion 8 of the bit to an outer cylindrical wall of the head portion 3 and is in fluid communication with a corresponding bore feed or Venturi channel 19. Each bore feed channel 19 extends through the bit from an outer surface of the bit head to the central bore 13 to provide a fluid path for the flushing medium to the central bore of the bit. As shown in the drawings, each bore feed channel 19 extends between the outer surface of the bit head and the central bore in a rearward direction, that is, at an acute angle to the longitudinal axis of the percussion bit. In the embodiments shown, each of the bore feed channels may be approximately 4 mm in diameter and the diameter of the channel is constant along its length. This relatively small diameter as compared with the flushing channels ensures that stresses in the bit are kept low, despite the introduction of additional holes in the same portion of the bit as the flushing channels. In alternate embodiments, the dimensions may differ but the bore feed channels may be substantially smaller in diameter than the flushing channels and/or the central bore and/or the flushing grooves.

In order to ensure that the flushing medium provided to the second plurality of flushing grooves is directed to the central bore via the bore feed channels, each of the second plurality of flushing grooves is truncated such that it does not extend to the cutting face of the bit. A forward end 20 of each of the second plurality of flushing grooves is sealed to prevent flushing medium from flowing to the cutting face of the bit. This is achieved by way of a chuck sleeve 21, arranged to extend around the bit head 3 forwardly of the drive chuck 4. The chuck sleeve 21 is an annular sleeve having an inner diameter that corresponds to an outer diameter of the bit head portion such that a close sliding fit is provided therebetween. In an alternate embodiment, the chuck sleeve may be replaced by an extended chuck arranged to extend around the bit head in a similar manner, that is, the chuck sleeve may be integrally formed with the chuck itself. However, use of a separate chuck sleeve may be advantageous since it may be considered a wear component which may be easily and cheaply replaced when worn. The chuck sleeve is retained in the assembly by way of an internal shoulder 22 provided at a rear end thereof which engages an outwardly directed shoulder 23 on the drive chuck. As shown in FIG. 1, the forward end 20 of each of the second plurality 18 of flushing grooves is sealed by the chuck sleeve, such that the flushing medium is directed into the corresponding bore feed channel. An outer diameter of the chuck sleeve may be substantially the same as an outer diameter of the bit cutting face. A further advantage of the chuck sleeve is that it effectively "plugs" the drilled hole, thereby encouraging a greater volume of flushing medium to be returned to the bit bore, further maximising sample recovery.

In use, a flushing medium such as air is supplied to the hammer and passes through channels 24 formed between the bit shank and the chuck and into the first and second pluralities of flushing grooves. In the embodiment shown, the channels 24 are formed between the splines on the bit shank and those on the chuck. In the alternate embodiment in which the shank is hexagonal (or octagonal), flushing medium passes through channels formed between the shank and the second hexagonal (or octagonal) profile of the chuck. The air which enters the first plurality 17 of flushing grooves is directed to the cutting face of the bit in the usual manner, from where it passes into the central bore of the bit via the flushing channels 16, along with drilled cuttings from the hole. The air which enters the second plurality 18 of flushing grooves is prevented from flowing to the cutting face of the bit and instead flows directly to the central bore via the bore feed channels 19. The additional flow path created by connecting a portion of the flushing grooves with the central bore and thus the sample tube of the hammer may create a suction or Venturi effect which increases the percentage of the drilled cuttings that are returned to the surface for analysis.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

What is claimed is:

1. A drill bit assembly for a reverse circulation down-the-hole hammer, comprising:

a percussion bit having an axially extending shank and a head portion with a cutting face at a forward end thereof;

engagement means on the axially extending shank for engagement with complementary engagement means on a drive chuck whereby rotational drive from the drive chuck may be transmitted to the percussion bit; and connection means on the drive chuck adapted for connecting the drive chuck to a drive means of the down-the-hole hammer;

wherein the percussion bit comprises:

a central bore in fluid communication with the cutting face of the bit for returning a sample of drilled cuttings to the surface, a first plurality of flushing grooves in an outer surface of the head portion of the bit, configured to deliver a supply of flushing medium to the cutting face of the bit; and a second plurality of flushing grooves in the outer surface of the head portion of the bit, configured to deliver a supply of the flushing medium to the central bore.

2. A drill bit assembly as claimed in claim 1, further comprising bit retaining means adapted for engagement with a bit retaining portion of the percussion bit to retain the percussion bit in the drill bit assembly.

3. A drill bit assembly as claimed in claim 2, wherein the bit retaining portion of the percussion bit comprises a retaining shoulder.

4. A drill bit assembly as claimed in claim 2, wherein the bit retaining means comprises a bit retaining ring disposed between an aligner and the drive chuck and arranged to engage the bit retaining portion of the percussion bit to retain the bit in the bit assembly.

5. A drill bit assembly as claimed in claim 1, wherein at least one flushing channel extends between the cutting face and the central bore of the percussion bit for returning the sample of drilled cuttings to the surface.

6. A drill bit assembly as claimed in claim 1, wherein the engagement means comprises a plurality of axially extending splines on the shank slideably engageable with a plurality of complementary splines formed internally of the drive chuck whereby the rotational drive from the chuck may be transmitted to the shank.

7. A drill bit assembly as claimed in claim 1, wherein each of the first plurality of flushing grooves extends from the engagement means on the bit to the cutting face of the bit to provide a fluid path for the flushing medium to the cutting face of the bit.

8. A drill bit assembly as claimed in claim 1, wherein each of the second plurality of flushing grooves is in fluid communication with a corresponding bore feed channel, each bore feed channel extending through the bit from the outer surface of the head portion to the central bore to provide a fluid path for the flushing medium to the central bore of the bit.

9. A drill bit assembly as claimed in claim 8, wherein a forward end of each of the second plurality of flushing grooves is sealed to prevent the flushing medium from flowing to the cutting face of the bit.

10. A drill bit assembly as claimed in claim 8, wherein each bore feed channel extends between the outer surface of the head portion and the central bore in a rearward direction.

11. A drill bit assembly as claimed in claim 8, where each bore feed channel extends between the outer surface of the head portion of the bit and the central bore at an acute angle to a longitudinal axis of the percussion bit.

12. A drill bit assembly as claimed in claim 8, further comprising a chuck sleeve arranged to extend around the head portion forwardly of the drive chuck.

13. A drill bit assembly as claimed in claim 12, wherein an inner diameter of the chuck sleeve corresponds to an outer diameter of the head portion.

14. A drill bit assembly as claimed in claim 12, wherein a forward end of each of the second plurality of flushing grooves is sealed by the chuck sleeve, such that the flushing medium is directed into the corresponding bore feed channel.

15. A drill bit assembly as claimed in claim 12, wherein each of the first plurality of flushing grooves extends from the engagement means on the bit to the cutting face of the bit between the outer surface of the head portion of the bit and an inner surface of the chuck sleeve to provide a fluid path for the flushing medium to the cutting face of the bit.

* * * * *